United States Patent [19]

Downing

[11] 4,003,487

[45] Jan. 18, 1977

[54] TRUCK OVERLOAD PROTECTIVE SYSTEM HAVING TRIP SIGNAL SAMPLING MEANS

[75] Inventor: Terry R. Downing, Hazel Crest, Ill.

[73] Assignee: Allis-Chalmers Corporation, Milwaukee, Wis.

[22] Filed: Apr. 3, 1975

[21] Appl. No.: 564,720

[52] U.S. Cl. ..... 214/673; 212/39 MS; 340/267 C

[51] Int. Cl.[2] ..... B65E 47/00

[58] Field of Search ..... 214/660, 670–674; 212/39 R, 39 MS, 39 A; 340/267 C; 33/366; 177/165, 210, 211

[56] References Cited

UNITED STATES PATENTS

| | | | |
|---|---|---|---|
| 3,203,672 | 8/1965 | Santos | 214/673 X |
| 3,591,030 | 7/1971 | Pachter | 214/673 |
| 3,631,537 | 12/1971 | Zibolski et al. | 340/267 C |
| 3,638,211 | 1/1972 | Sanchez | 212/39 MS X |
| 3,819,922 | 6/1974 | Horn et al. | 340/267 C |
| 3,850,323 | 11/1974 | Ekstrom | 214/673 |

FOREIGN PATENTS OR APPLICATIONS

| | | | |
|---|---|---|---|
| 1,360,128 | 7/1974 | United Kingdom | 212/39 MS |

*Primary Examiner*—Robert J. Spar
*Assistant Examiner*—R. B. Johnson
*Attorney, Agent, or Firm*—Lee H. Kaiser

[57] ABSTRACT

An overload protective system continuousy monitors the forward overturning moment on a counterbalanced lift truck and prevents further raising of the carriage or further forward tilting of the mast when the tilting moment is excessive. A strain gage sensor connected in an electrical bridge derives a strain signal proportional to the mechanical strain in a load carrying anchor pin for the tilt jack which resists the forward overturning moment acting on the truck; a differential amplifier raises the level of the strain signal; a comparator which receives the output of the differential amplifier derives a trip signal when the strain signal reaches a predetermined magnitude; a shift register receiving clock pulses from an oscillator as a time reference records the history of the comparator output and a decoder analyzes the shift register output and sets a latch when the trip signal comparator output has been present for a predetermined interval of time; and disabling means responsive to setting of the latch de-energize operating coils for blocking valves which inhibit further raising of the carriage or further forward tilting of the mast.

21 Claims, 4 Drawing Figures

TRUCK OVERLOAD PROTECTIVE SYSTEM HAVING TRIP SIGNAL SAMPLING MEANS

BACKGROUND OF THE INVENTION

This invention relates to an overload protection system for a counterbalanced lift truck and in particular to an overload protection system which is responsive to the tilting moment acting on the truck and inhibits further raising of the load support or tilting the mast further forward when the tilting moment is excessive, thereby preventing the operator from increasing the danger of overturning the truck during material handling operations.

Several systems are known for preventing excessive forward overturning, or tilting moment in a counterbalanced lift truck. While known systems have considerable utility, none has actually proven fully effective because of such drawbacks as high cost, unnecessary space requirement, difficulty to maintain in efficient operating condition, not being fully automatic, not being tamperproof, not being fail-safe, or being unstable and providing false response in operation.

OBJECTS OF THE INVENTION

It is an object of this invention to provide an improved overload protection system for a counterbalanced lift truck which overcomes the above disadvantages of prior art devices. Another object is to provide such an improved electrical overload protective system which is highly stable in operation and does not respond falsely to noise and transient signals. Another object is to provide such an electrical overload protective system which analyzes the trip signal over an interval of time to determine that excessive overload actually exists before inhibiting further raising of the load or forward tilting of the mast and thus prevent false response. A further object is to provide such an overload protective system which is fail-safe in operation.

SUMMARY OF THE INVENTION

An overload protection system for a counterbalanced vehicle such as a lift truck having a shiftable load support and power means operable to shift the load support on the vehicle continuously monitors the tilting moment acting on the vehicle and inhibits further shifting of the load support in a direction to increase the tilting moment when danger exists that the vehicle may turn over. The power means for shifting the load support on the vehicle includes a load carrying member which resists the tilting moment and is subjected to the forces exerted by the power means. A strain gage sensor generates an electrical "strain" signal whose magnitude varies in proportion to the mechanical strain on the load carrying member. A comparator derives a trip signal when the strain signal reaches a predetermined magnitude indicating that the tilting moment acting on the vehicle is excessive. Sampling means repetitively samples the output of the comparator and derives an output only when the trip signal is present for a predetermined time interval, and disabling means is responsive to the output of the sampling means and inhibits the power means from shifting the load support in a direction which would increase the tilting moment but permits the operator to shift the load in a direction to decrease the tilting moment.

In a preferred embodiment, the vehicle has a lift jack for elevating the laod support on a tiltable mast and a tilt jack for controlling the tilt of the mast; the load carrying member is an anchor pin for the tilt jack; the strain gage is affixed to the anchor pin and connected in a bridge circuit; a differential amplifier connected across the diagonal of the bridge increases the level of the strain signal; a comparator operational amplifier flips its output to the opposite polarity to generate the trip signal when the strain signal reaches a predetermined magnitude; the sampling means includes a shift register which receives clock pulses from an oscillator as a time reference and records the history of the comparator output over a period of time and a decoder which analyzes the shift register output and sets a latch when the shift register output indicates that the trip signal has been present for a predetermined time interval; and the disabling means is responsive to setting of the latch to block flow of fluid to the power means which could result in further raising of the load support by the lift jack or further forward tilting of the mast by the tilt jack, but permit lowering of the load support and backward tilting of the mast.

DESCRIPTION OF THE DRAWINGS

These and other objects and advantages of the invention will be more readily apparent from the following detailed description when considered in conjunction with the accompanying drawing wherein.

DETAILED DESCRIPTION

Figure 1:
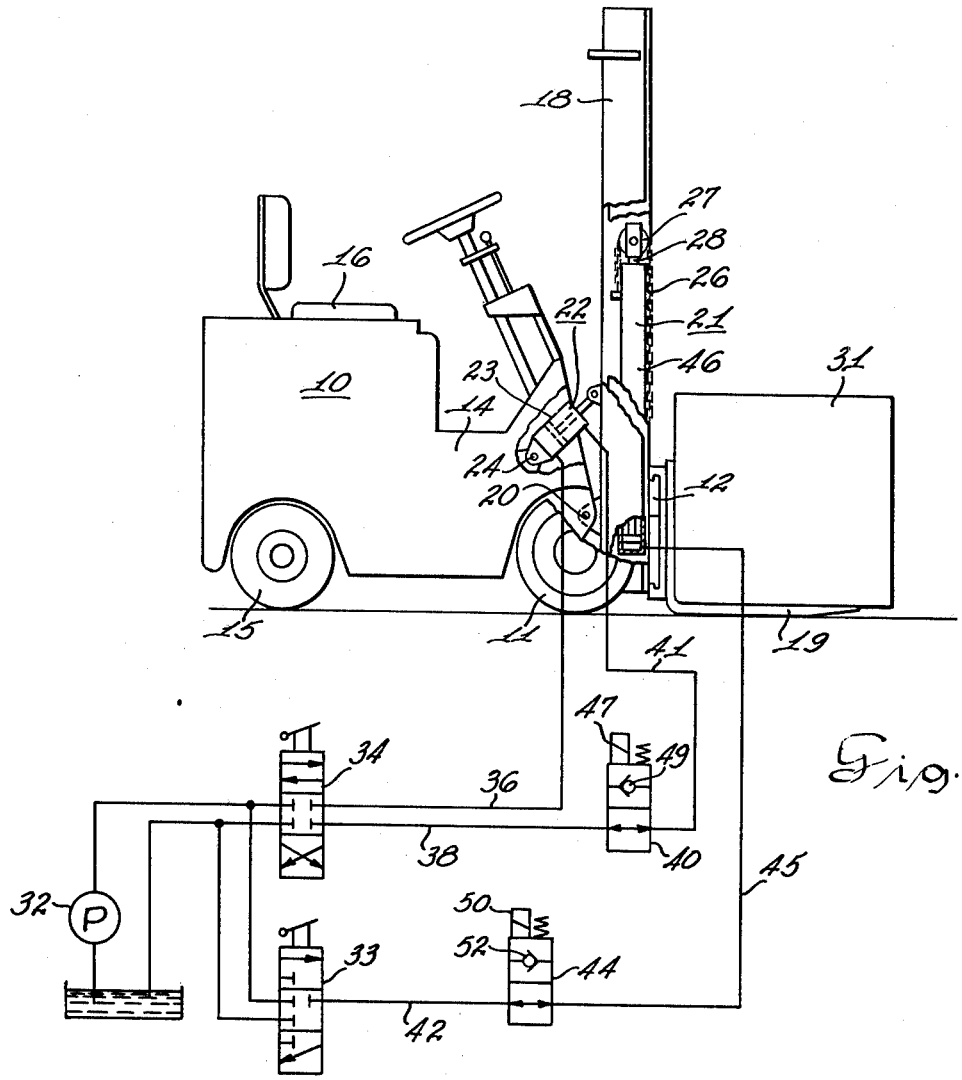
FIG. 1 is a side view of a lift truck embodying the invention and schematically illustrates the hydraulic control circuit for the lift and tilt jacks.

The overload system of the invention continuously monitors the tilting, or forward overturning moment acting on a counterbalanced vehicle, such as a lift truck 10 shown in FIG. 1, tending to tilt the vehicle about its front wheels 11 as a fulcrum and is responsive to an excessive tilting moment to prevent shifting of a load support, or carriage 12 on the vehicle in a direction which would increase the forward tilting moment, but permits the operator to shift the load support on the vehicle in a direction to decrease the forward overturning moment. The lift truck 10 also has a main frame 14, a pair of rear steerable wheels 15, an operator's seat 16, load supporting means including a vertical mast 18 pivotally connected to frame 14 on a transverse pivot axis by pins 20 and also including the shiftable load support, or carriage 12 with lift forks 19, and power means for shifting the load support 12 on the vehicle including a single acting lift jack 21 and a double acting tilt jack 22. Tilt jack 22 maintains mast 18 in desired upright position by expansion or contraction and has a cylinder 23 pivotally connected on a transverse axis to the frame 14 about a load carrying tilt jack anchor pin 24 and a piston rod 25 pivotally connected on a transverse axis to the mast 18. Lift jack 21 supports the carriage 12 with lift forks 19 through a chain 26 trained over a pulley 27 mounted on top of the lift jack piston 28. When lift jack 21 is extended, carriage 12 with attached forks 19 supporting a load 31 thereon is raised, thereby creating a clockwise load moment about tilt pin 24. When the lift jack 21 is raised and mast 18 is tilted forward, a tilting or forward overturning moment acts upon truck 10 tending to tilt it about front wheels 11 as a fulcrum as a result of this shifting of load support 12 on the vehicle, (i.e., as a result of the forward tilting of mast 18 and raising of carriage 12 on mast 18), and such forward overturning moment is resisted by tilt jack 22 and by tilt anchor pin 24 which pivotally anchors tilt jack 22 to frame 14, whereby tilt pin 24 is subjected to mechanical stress which is proportional to the tilting moment acting on the truck 10.

The hydraulic control system for lift jack 21 and tilt jack 22 may include a pump 32, manually operable lift and tilt control valves 33 and 34; a tilt cylinder supply conduit 36 connecting the manual tilt control valve 34 with the closed end of the cylinder 23 of tilt jack 22; a tilt supply conduit 38 connecting tilt valve 34 of a blocking valve 40 which is connected through a conduit 41 to the rod end of tilt jack cylinder 23, a lift supply conduit 42 connecting the manual lift valve 33 to a blocking valve 44 which is connected through a conduit 45 to the bottom end of cylinder 46 of lift jack 21.

Blocking valve 40 is normally held open by its operating coil 47, thereby permitting the operator to tilt mast 18 forward by operating tilt valve 34 to supply pressurized fluid from pump 32 to the closed end of tilt jack cylinder 23 through conduit 36 and force fluid out of the rod end of tilt jack cylinder 23 through conduit 41. When operating coil 47 of blocking valve 40 is de-energized, valve 40 closes so that check valve 49 prevents discharge of fluid from the rod end of tilt jack 23 through conduit 41, thereby preventing further forward tilting of mast 18, but check valve 49 permits the operator to supply pressurized fluid from pump 32 to the rod end of the tilt jack cylinder 23 through conduit 41 and thereby decrease the forward tilt of mast 18.

Blocking valve 44 is normally held open by its operating coil 50, thereby permitting the operator to raise carriage 12 by supplying pressurized fluid through valves 33 and 44 in series and conduit 45 to the bottom end of the cylinder 46 of lift jack 21. When operating coil 50 is de-engerized, blocking valve 44 closes so that check valve 52 blocks supply of presurized fluid to the bottom end of lift jack cylinder 46 to thereby prevent further raising of carriage 12 but permitting discharge of fluid from the bottom end of lift jack cylinder 46, thus permitting the truck operator to lower the load 31.

Figure 2:
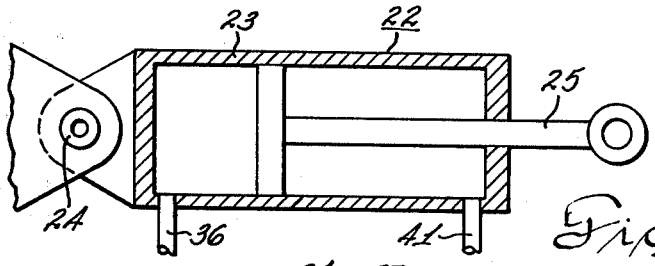
FIG. 2 is a schematic cross-section view through the tilt jack of the truck shown in FIG. 1.
Figure 3:
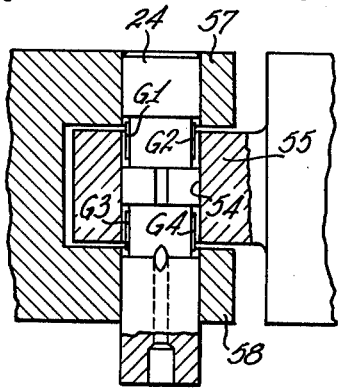
FIG. 3 is a partial cross-sectional view through the tilt jack anchor pin pivotally connecting the closed end of the tilt jack to the frame fo the truck of FIG. 1.
Figure 4:
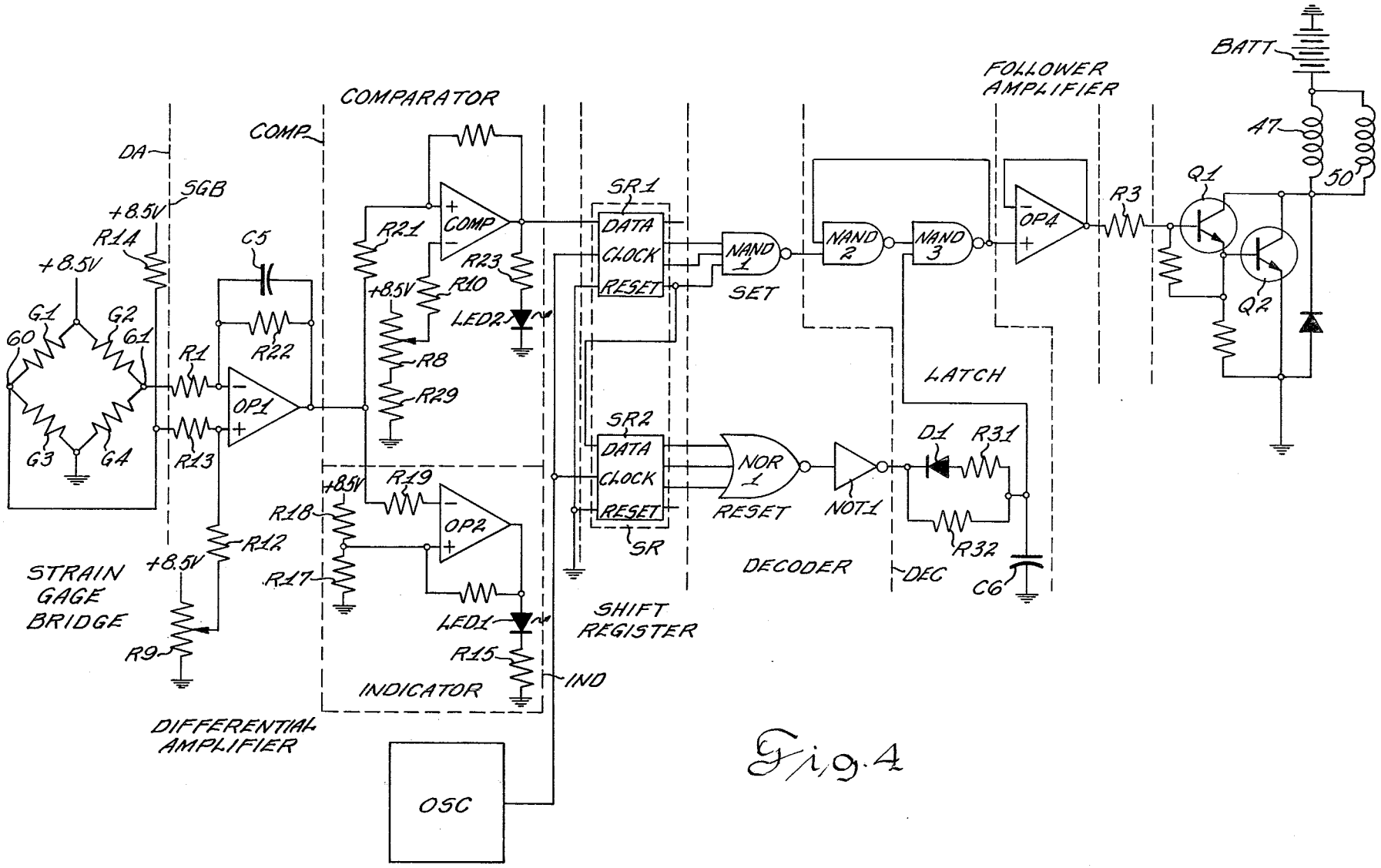
FIG. 4 is a schematic circuit diagram of the overload protective system of the invention which is incorporated in the truck shown in FIG. 1.

Four resistance strain gages G1, G2, G3, G4 may be mounted externally on tilt anchor pin 24 and arranged in a full bridge electrical circuit SGB shown in FIG. 4. Tilt pin 24 is shown in FIGS. 2 and 3 as extending through an aperture 54 in a plate 55 affixed to the closed end of tilt jack cylinder 23 so that the midportion of pin 24 is encircled by aperture 54, and tilt pin 24 also extends through spaced eye members 57 and 58 welded to truck frame 14 so that eye members 57 and 58 engage tilt pin 24 adjacent its end, and thus the pin 24 is subjected to bending stress proportional to the forward tilting moment acting on the truck. The junction of strain gages G3 and G4 may be grounded and a regulated unidirectional power supply shown as +8.5 volts may be applied across a diagonal of bridge SGB between the junction of gages G1 and G2 and ground. When no load is supported on carriage 12, the strain gage sensor bridge SGB will be unbalanced due to the weight of carriage 12 and mast 18 and also due to manufacturing tolerance in strain gages G1 to G4, and an unbalance voltage may exist across output terminals 60 and 61 which may be compensated for as described hereinafter.

A high gain differential amplifier OP1 of the operational amplifier type is coupled across the output terminals of bridge SGB. Isolating resistances R1 and R13 respectively connect bridge output terminals 60 and 61 to the inverting and noninverting inputs of amplifier OP1. Bridge SGB becomes further unbalanced when the force applied to tilt anchor pin 24 increases, and bridge SGB generates a strain signal in proportion to mechanical strain in anchor pin 24. Differential amplifier OP1 raises the level of the strain signal output from bridge SGB. Bridge output terminal 60 is connected through a resistance R14 to the +8.5 volts supply to form a voltage divider, which provides an unbalancing effect on OP1 if the lead to terminal 60 was severed. This will be discussed hereinafter and is identified here as part of the fail-safe function. The noninverting input of OP1 is coupled through a resistance R12 to the wiper of a bridge unbalance compensation potentiometer R9 whose winding is connected between the +8.5 volt supply and ground and which permits compensation for minor unbalance in bridge SGB so that, after adjustment by R9 to set the output of amplifier OP1 to approximately zero volts, the inputs of OP1 effectively see zero voltage across the bridge output terminals 60 and 61 when carriage 12 is unloaded. The currents resulting from bridge unbalance and from voltage divider R14, R13, R12, R9 are summed at the noninverting input of OP1 and the sum set to zero by adjusting compensation potentiometer R9. Without compensation potentiometer R9, the output of operational amplifier OP1 would swing over a wide voltage range as a result of relatively small differential voltage applied across the inputs of OP1 because its gain is very high. However, unbalance compensation potentiometer R9 permits the operator to set the output of OP1 to approximately zero volts, thereby indicating the zero potential difference exists across its inverting and noninverting inputs and that bridge SGB is, in effect, balanced (when no load exists on carriage 12).

In order to facilitate compensation for unbalance in bridge SGB by menas of potentiometer R9, a visual indicator IND is provided which gives a visual signal when the output of OP1 is approximately zero volts. The output of OP1 is coupled through a resistance R19 to the inverting input of an operational amplifier OP2 of indicater IND which has its noninverting input coupled to a 0.1 volt source at the junction of two resistances R18 and R17 connected in series between the +8.5 volt supply and ground. The output of OP2 is coupled through a light emitting diode LED 1 and a resistance R15 to ground. When the unbalance in the bridge SGB is compensated for by R9 so that the output of OP1 is less than 0.1 volts (when carriage 12 is unloaded), the output of OP2 is positive and diode LED 1 is lighted to visually indicate that strain gage sensor SGB is, in effect, balanced. When bridge SGB is unbalanced (for example, by load 31 on carriage 12) so that the output of OP1 is greater than 0.1 volts, the output of OP2 is negative and diode LED 1 is not lighted.

In summary, slight unbalance may exist in bridge SGB, but such unbalance is compensated for by the setting of R9 which adjusts the output of high gain amplifier OP1 to approximately zero volts so that the inputs to OP1, in effect, see zero output voltage from bridge SGB when carriage 2 is unloaded.

A feedback resistance R22 connected in shunt with a feedback capacitor C5 between the output and the inverting input of oerational amplifier OP1 causes OP1 to block high frequency noise signals and transients about a predetermined frequency, for example, above 6 Hz. Such low pass filter action by amplifier OP1, in combination with the shift register sampling means described herein, reduces the effects of externally generated noise, for example, eliminates square wave noise signals that might be generated if the vehicle were to pass over obstacles at regularly spaced intervals.

The output of differential amplifier OP1 is coupled through a resistance R21 to the noninverting input of a comparator operational amplifier COMP which generates a trip signal when the forward tilting moment acting on the vehicle, and thus the strain signal from bridge SGB, exceeds a predetermined magnitude. The inverting input of COMP is coupled through a resistance R10 to the wiper of a trip point adjusting potentiometer R8 whose winding is connected in series with a resistance R29 between the +8.5 volt supply and ground so that the output of COMP is normally negative or logic 0. Trip point adjusting potentiometer R8 applies a predetermined positive voltage to the inverting input of COMP and thus permits setting of the predetermined magnitude of forward tilting moment beyond which carriage 12 should not be raised further or mast 18 tilted further forward.

The output of comparator amplifier COMP is coupled through a light emitting diode LED 2 in series with a resistance R23 to ground so that the diode LED 2 gives a visual signal when COMP derives a logic 1 trip signal indicating that the tilting moment acting on the truck is excessive.

The output of comparator COMP is also applied to the DATA input of a shift register SR which records the history of the output of comparator COMP over a period of time, i.e., which records whether the trip signal from COMP (and excessive tilting moment acting on the vehicle) has actually existed for a period of time. Shift register SR may comprise two shift register units SR1 and SR2 in a single integrated circuit package each of which has four outputs and with the fourth output from SR1 coupled to the DATA input of SR2. The first output of SR1 and the fourth output of SR2 are not used so that shift register SR has six outputs.

An oscillator OSC generates a train of clock pulses which provide a time reference and are applied to the CLOCK inputs of both SR1 and SR2 so that shift register SR shifts data bits applied to its DATA input one place to the succeeding output each time a shift pulse (i.e., a clock pulse) is received on the CLOCK inputs to SR1 and SR2. Thus, each time a logic 1 trip signal exists on the DATA input of SR when a clock pulse is received, the first output of shift register SR goes to logic 1 and the data previously on each output is transferred to the succeeding output. Shift register SR is thus of the serial input, parallel output type and, in conjunction with oscillator OSC, creates a sequential data string representing the output of comparator COMP (presense or absence of logic 1 trip signal) over a period of time.

The data accumulated in shift register SR is deciphered, or analyzed by a decoder DEC. Shift register SR in combination with decoder DEC either (a) transmits the trip signal through a SET channel to set a LATCH and de-energize blocking valve operating coils 47 or 50, or (b) transmits a reset signal through a RESET channel to reset the LATCH and energize operating coils 47 and 50. The SET channel includes SR1 having four outputs with the second, third and fourth coupled to the inputs of a three-joint gate NAND 1 of the decoder DEC; a two-input gate NAND 2 of the LATCH which receives the output of NAND 1, and a two-input gate NAND 3 of LATCH which receives the output of NaND 2. The RESET channel include SR2 having four outputs with the first, second and third coupled to the inputs of a three-input gate NOR 1 of the decoder DEC and an inverter gate NOT 1 which receives the output of NOR 1 and whose output is coupled to an input of gate NAND 3 of LATCH. The fourth output of SR1 is applied to the DATA input of SR2; the time reference clock pulses from oscillator OSC are applied to the CLOCK inputs of both SR1 and SR2, and the RESET inputs of both SR1 and SR2 are grounded.

The circuit of oscillator OSC is not shown, but OSC is preferably adjustable so that the frequency of its output clock pulses may be selectively set in the range from 10 Hz to 40 Hz. The shift register SR using clock pulses from oscillator OSC as a time reference thus records the history of the output from comparator COMP over a period of time and together with decoder DEC and the LATCH samples whether the trip signal from COMP has been present or absent over a period of time.

When the forward tilting moment acting on the vehicle is not excessive, the outward of comparator COMP is logic 0; the six outputs of shift register SR are all logic 0; the output of NAND 1 is logic 1 and the output of NOR 1 is logic 1. Consequently, in this condition of the truck, the elements are in the following states:

| | |
|---|---|
| NAND 1 | Logic 1 |
| NOR 1 | Logic 1 |
| NAND 2 | Logic 0 |
| NOT 1 | Logic 0 |
| NAND 3 | Logic 1 |
| LATCH | Reset |
| Q1 | on |
| Q2 | on |
| 47 (operating coil) | Energized |
| 50 (operative coil) | Energized |

Since operating coils 47 and 50 are energized, blocking valves 40 and 44 are opened and mast 18 can be tilted forward and carriage 12 can be raised on mast 18.

If the forward tilting moment acting on the truck becomes excessive, strain gage sensor bridge SGB becomes sufficiently unbalanced and the output of differential amplifier OP1 becomes sufficiently high to flip the output of comparator amplifier COMP to logic 1 and thereby derive the trip signal. Each time a clock pulse from oscillator OSC is coupled to the CLOCK input of SR1 while the logic 1 trip signal exists on its DATA input, the first output of SR1 goes to logic 1 and the data that was on the output is transferred to the second output. When all outputs of SR1 go to logic 1, the output of gate NAND 1 of the decoder goes to logic 0 and causes gate NAND 2 to go to logic 1, but the output of NAND 3 of the LATCH is not changed because it still has logic 0 on one input from gate NOT 1. However, when a succeeding clock pulse changes the first output of SR2 to logic 1, NOR 1 goes to logic 0, NOT 1 goes to logic 1 and NAND 3 goes to logic 0 to set the LATCH. The logic 0 "disable signal" from NAND 3 is coupled through a voltage follower amplifier OP4 and resistace R3 to the base of NPN base drive transistor Q1 of an operating coil driver amplifier to thereby turn Q1 off. This turns NPN power transistor Q2 off to de-engerize operating coils 47 and 50 of blocking valves 40 and 44, thereby preventing further raising of load support 12 and also preventing further tilting of mast 18 in the forward direction. Transistors Q1 and Q2 are connected in Darlington arrangement, and the emmiter-collector circuit of Q2 is connected in series with the paralleled operating windings 47 and 50 and a battery BATT carried by the truck. The LATCH and the operating winding driver amplifier Q1, Q2 may be considered disabling means, or inhibiting means which close blocking valves 40 and 44 and thus inhibit the lift and tilt jacks from operation in a direction which would increase the forward overturning moment but permit the operator to lower the carriage 12 and tilt mast 18 backward.

If the frequency of clock pulses from oscillator OSC is 10 cycles per second, shift register SR will record the history (i.e., the presence or absence) of the logic 1 trip signal from comparator COMP over a period of 6 times 0.1 equals 0.6 seconds on its six outputs. Table 1 shows the condition of the LATCH for all possible combinations of data on the six outputs from shift register SR. Considering the clock pulses from OSC as a time reference and that a data bit is generated each time a clock pulse from OSC is applied to the CLOCK inputs of SR1 and SR2, Table 1 can also be considered to show the sequential data "string" which must be applied to the DATA input of SR1 so that shift register SR, decoder DEC, and the LATCH will result in the indicated output from the LATCH:

Table 1

| Input Data String or (SR Output State) | LATCH Output (From NAND 3) |
|---|---|
| 1 1 1 1 0 0 | Logic 0 |
| 1 1 1 0 1 0 | Logic 0 |
| 1 1 1 0 0 1 | Logic 0 |
| 1 1 1 1 1 0 | Logic 0 |
| 1 1 1 0 1 1 | Logic 0 |
| 1 1 1 1 0 1 | Logic 0 |
| 1 1 1 1 1 1 | Logic 0 |
| All other inputs | Logic 1 |
| Time → | |

When power transistor Q2 is off so that operating coils 47 and 50 are de-energized to close blocking valves 40 and 44, fluid can be exhausted from lift jack cylinder 46 to lower carriage 12 and also fluid from pump 32 can be supplied to the closed end of tilt jack cylinder 23 to tilt the mast backward. When the operator has either lowered carriage 12 or tilted mast 18 backward to the point where forward tilting moment on the truck is no longer excessive, bridge SGB becomes less unbalanced, the output of differential amplifier OP1 decreases, and the output of comparator COMP flips to logic 0 to erase the trip signal. With logic 0 on the DATA input lead, the first output of SR1 goes to logic 0 when the succeeding clock pulse from OSC is applied to its CLOCK input. On the succeeding clock pulse, the second output of SR1 goes to logic 0, and NAND 1 goes to logic 1, but NAND 2 does not change state (and the LATCH remains set) because NAND 2 has logic 0 on an input from NAND 3. The LATCH remains set even after the fourth clock pulse input (with logic 0 on the DATA input) when the first output of SR2 goes to logic 0 since NOR 1 still has logic 1 inputs on two input leads. After six successive clock pulses from OSC with logic 0 from COMP on the DATA input to SR1, all six outputs from SR go to logic 0, NOR 1 goes to logic 1, NOT 1 goes to logic 0, NAND 3 goes to logic 1 to reset the LATCH, NAND 2 goes to logic 0 to hold the LATCH reset, OP4 couples the logic 1 disable signal output from NAND 3 to NPN base drive transistor Q1 to turn it and power transistor Q2 on, thereby energizing operating coils 47 and 50 to open blocking valves 40 and 44 and enable the tilt and lift jacks so that load support 12 can again be raised and mast 18 tilted forward.

Table 2 truth table shows the various combinations of data which can appear on the six outputs from shift register SR to reset the LATCH so it provides a logic 1 output and turns on Q1 and Q2 to energize operating coils 47 and 50:

Table 2

| SR Output State or (Input Data String) | LATCH Output (From NAND 3) |
|---|---|
| 0 0 0 0 0 0 | Logic 1 |
| 1 0 0 0 0 0 | Logic 1 |
| 0 1 0 0 0 0 | Logic 1 |
| 0 0 1 0 0 0 | Logic 1 |
| 1 1 0 0 0 0 | Logic 1 |
| 1 0 1 0 0 0 | Logic 1 |
| 0 1 1 0 0 0 | Logic 1 |
| All other inputs | Logic 0 |
| Time → | |

Stated in another manner, considering the clock pulses from oscillator OSC as a time reference, Table 2 shows the sequential data string which must be applied to shift register SR, decoder DEC, and the LATCH (at the DATA input of SR1) to provide the indicated outputs from the LATCH.

An RC time delay network between the decoder DEC and the LATCH provides a time delay in the RESET channel to assure that the LATCH will not be falsely reset as a result of noise or transient signals that might be caused by oscillations in the vehicle. The time delay network includes a diode D1 in series with a resistance R31 connected between the output of gate NOT 1 and the input of NAND 3; a resistor R32 of relatively high magnitude in parallel to the series arrangement of D1 and R31; and a capacitor C6 connected between the input of NAND 3 and ground. A logic 1 signal from NOT 1 is passed through diode D1 and resistance R31 without delay to NAND 3. However, a logic 0 "reset signal from gate NOT 1 is blocked by D1 and must charge capacitor C6 through high resistance R32 before NAND 3 goes to logic 1 to reset the LATCH, thereby requiring a relatively long time delay in resetting the LATCH and preventing false resetting that might otherwise be caused by vehicle noise and oscillations. Such time delay network may assure serveral seconds delay in response to the operator's commands before the LATCH is reset and normal material handling conditions are restored.

The disclosed overload protective system is fail-safe in that, if the operator were to sever leads in an attempt to defeat the protective system so that he could work faster and thus increase his piece rate, the severed leads would result in unbalance of bridge SGB or of high gain operational amplifier OP1 with resultant closing of blocking valves 40 and 44, thus absolutely inhibiting raising of load support 12 or forward tilting of mast 18.

While only a single embodiment of my invention has been illustrated and described, many modifications and variations thereof will be readily apparent to those skilled in the art, and consequently, it should be understood that I do not intend to be limited to the particular embodiment shown and described.

The embodiments of the invention in which an exclusive property or privilege is claimed are defined as follows:

1. An overload protective system for a vehicle having a frame, load supporting means including a shiftable load support on said vehicle, power means affixed to said frame and operable to shift said load support on said vehicle and including a load carrying member which is subjected to the forces exerted by said power means and resists the tilting moment acting on said vehicle as a result of the position of said load support on said vehicle, strain gage sensor means attached to said load carrying member for detecting the mechanical strain in said member and for generating a strain signal whose magnitude varies as a function of said mechanical strain, comparator means for generating a trip signal when said strain signal reaches a predetermined magnitude indicating that said tilting moment is excessive, sampling means for repetitively sampling the output of said comparator means over a period of time and for deriving a disable signal output only when said trip signal is present for a predetermined time interval, and disabling means responsive to said disable signal output from said sampling means for inhibitng said power means from shifting said load support on said vehicle in a direction to increase said tilting moment.

2. An overload protective system in accordance with claim 1 wherein said load supporting means includes a mast pivotally mounted on said frame about a horizontal axis and said power means is a lift jack operatively connected to said load support for elevating and lowering said load support on said mast.

3. An overload protective system in accordance with claim 1 wherein said load supporting means includes a mast pivotally mounted on said frame about a horizontal axis and said power means is a tilt jack having its opposite ends connected to said frame and to said mast and operable to vary the tilt of said mast, and said load carrying member is subjected to the forced exerted by said tilt jack.

4. An overload protective system in accordance with claim 1 wherein said load supporting means includes a mast pivotally mounted on said frame about a horizontal axis, said load support is reciprocable longitudinally of said mast, and said power means includes a lift jack for elevating and lowering said load support on said mast and a tilt jack having its opposite ends connected to the frame and to the mast for controlling the tilt of said mast, and wherein said load carrying member is subjected to the force exerted by said tilt jack.

5. An overload protective system in accordance with claim 4 wherein said disabling means inhibits operation of said lift jack in a direction to raise said load support and also inhibits operation of said tilt jack in a direction to tilt said mast forward but permits operation of said lift jack in a direction to lower said load support and also permits operation of said tilt jack in a direction to tilt said mast backward.

6. An overload protective system in accordance with claim 1 wherein said strain gage sensor means includes a resistance strain gage connected in a bridge circuit and a differential amplifier having its inputs connected across a diagonal of said bridge circuit.

7. An overload protective system in accordance with claim 6 wherein said comparator means includes an operational amplifier receiving the output of said differential amplifier on one of its inputs and trip point adjusting means for applying a voltage of selectively variable magnitude to the other input of said operational amplifier.

8. An overload protective system in accordance with claim 7 wherein said sampling means includes an oscillator for deriving a train of clock pulses which provide a time reference, and a serial input parallel output shift register having data and clock inputs which respectively receive the output of said comparator means and said clock pulses from said oscillator as inputs, said shift register transferring the information on said data input to an output each time it receives a clock pulse and shifting the data on its outputs one place each time it receives a clock pulse, whereby the outputs of said shift register are a record of the output of said comparator means over an interval of time.

9. An overload protective system in accordance with claim 8 wherein said sampling means also includes a decoder coupled to a plurality of the outputs of said shift register and said sampling means provide said disable signal output only when said trip signal exists on said plurality of shift register outputs.

10. An overload protective system in accordance with claim 9 wherein said sampling means also includes a bistable latch which can be set and reset and is set by the output of said decoder when said trip signal exists on said plurality of shift register outputs, and said latch generates said disable signal output when it is set and removes said disable signal output when it is reset.

11. An overload protective system in accordance with claim 10 wherein said decoder includes means responsive to the absence of said trip signal on a plurality of said shift register outputs for generating a reset signal and said latch is reset by said reset signal.

12. An overload protective system in accordance with claim 11 and including time delay means between said means for generating said reset signal and said latch for delaying the application of said reset signal to said latch.

13. An overload protective system for a vehicle having a frame, a mast tiltable on the frame about a horizontal axis, a load support elevatable on the mast, a lift jack for raising and lowering said load support on said mast, a tilt jack having its opposite ends connected to the frame and to the mast for controlling the tilt of said mast, a load carrying member subjected to the force exerted by said tilt jack and resisting the forward overturning moment acting on said vehicle, strain gage sensor means attached to said load carrying member for detecting the mechanical strain in said load carrying member and for generating a strain signal whose magnitude varies as a function of said mechanical strain, comparator means for generating a trip signal when said strain signal reaches a predetermined magnitude indicating that said forward overturning moment is excessive, sampling means for repetitively sampling the output of said comparator means over a period of time and for deriving a disable signal output only when said trip signal is present for a predetermined time interval, and disabling means responsive to the disable signal output from said sampling means for inhibiting said lift jack from raising but permitting it to lower said load support and for also inhibiting said tilt jack from tilting said mast further forward but permitting it to tilt said mast backward.

14. An overload protective system in accordance with claim 13 wherein said strain gage sensor means includes a resistance strain gage connected in a bridge circuit and a differential amplifier having its inputs connected across a diagonal of said bridge circuit.

15. An overload protective system in accordance with claim 14 wherein said comparator means includes an operational amplifier receiving the output of said differential amplifier on one of its inputs and trip point adjusting means for applying a voltage of selectively variable magnitude to the other input of said operational amplifier.

16. An overload protective system in accordance with claim 15 wherein said sampling means includes an oscillator for generating a train of clock pulses which provide a time reference, and a serial input, parallel output shift register having data and clock inputs which respectively receive the output of said comparator means and the clock pulses from said oscillator as inputs, said shift register transferring the information on its data input to an output each time it receives a clock pulse and shifting the data on its outputs one place each time it receives a clock pulse, whereby the outputs of said shift register are a record of the output of said comparator means over an interval of time.

17. An overload protective sysatem in accordance with claim 16 wherein said sampling means also includes a decoder coupled to a plurality of the outputs of said shift register and said sampling means provides said disable signal output only when said trip signal exists on said plurality of shift register outputs.

18. An overload protective system in accordance with claim 17 wherein said sampling means also includes a bistable latch which is adapted to be set and reset and is set by the output of said decoder when said trip signal exists on said plurality of shift register outputs, and said latch generates said disable signal output from said sampling means when it is set and removes it when it is reset.

19. An overload protective system in accordance with claim 18 wherein said decoder includes means responsive to the absence of said trip signal on a plurality of said shift register outputs for generating a reset signal, and wherein said latch is reset by said reset signal.

20. An overload protective system in accordance with claim 13 wherein said lift jack is of the hydraulic type, and including valve means having a operating winding and being operable to block flow of pressurized fluid to said lift jack to thereby inhibit raising of said load support, said disabling means includes a semiconductor power switch connected in series with said operating winding, and means responsive to said disable signal output from said sampling means for turning off said semiconductor power switch.

21. An overload protective system for a vehicle having a frame and a lift mechanism including a shiftable load support for raising and lowering loads and including a load carrying member and power means applied to said frame for operating said lift mechanism to shift said load support on said vehicle, said load carrying member being subjected to the force exerted by said power means and resisting the tilting moment acting on said vehicle as a result of the position of said load support on said vehicle, strain gage sensor means attached to said member for sensing the mechanical strain in said load carrying member and generating a strain signal whose magnitude is a function of said mechanical strain, comparator means for deriving a trip signal when said strain signal reaches a predetermined magnitude indicating that said lift mechanism is overloaded, sampling means for repetitively sampling the output of said comparator means over a time interval and for deriving a disable signal output only when said trip signal is present for a predetermined time interval, and means responsive to said disable signal output for preventing said power means for operating said lift mechanism in a load raising direction.

* * * * *

UNITED STATES PATENT OFFICE
CERTIFICATE OF CORRECTION

Patent No. 4,003,487 Dated January 18, 1977

Inventor(s) Terry R. Downing

It is certified that error appears in the above-identified patent and that said Letters Patent are hereby corrected as shown below:

In the Abstract, line 1, "continuousy" should have been --- continuously --- ;

Column 9, line 34, "inhibitng" should have been --- inhibiting --- ;

Column 9, line 49, "forced" should have been --- forces --- ;

Column 11, line 32, "sysatem" should have been --- system --- ;

Column 12, line 23, "applied" should have been --- affixed --- .

Signed and Sealed this

Third Day of May 1977

[SEAL]

*Attest:*

RUTH C. MASON
*Attesting Officer*

C. MARSHALL DANN
*Commissioner of Patents and Trademarks*